US008287405B1

(12) United States Patent
Martinez

(10) Patent No.: US 8,287,405 B1
(45) Date of Patent: Oct. 16, 2012

(54) BATTING MACHINE

(76) Inventor: Frank Martinez, Rock Face, GA (US)

( * ) Notice: Subject to any disclaimer, the term of this patent is extended or adjusted under 35 U.S.C. 154(b) by 106 days.

(21) Appl. No.: 12/806,412

(22) Filed: Aug. 12, 2010

(51) Int. Cl.
*A63B 69/00* (2006.01)

(52) U.S. Cl. ..... 473/451

(58) Field of Classification Search ..... 473/451, 473/429, 417, 423, 453, 441, 351, 486; 482/83
See application file for complete search history.

(56) References Cited

U.S. PATENT DOCUMENTS 3,794,320 A * 2/1974 Salmont ..... 473/429
4,836,533 A * 6/1989 Dong ..... 482/83
5,685,542 A * 11/1997 Weis ..... 473/459
6,551,204 B1 * 4/2003 Di Re ..... 473/417
6,659,891 B2 * 12/2003 Lloyd ..... 473/429
6,716,121 B1 * 4/2004 Brown ..... 473/451
6,802,799 B2 * 10/2004 Gomez ..... 482/83
7,322,893 B2 * 1/2008 Bright ..... 473/441
2007/0054756 A1 * 3/2007 Hanson et al. ..... 473/451

* cited by examiner

*Primary Examiner* — Gene Kim
*Assistant Examiner* — M Chambers

(57) ABSTRACT

The Batting Machine is a device used during baseball practice to help players develop a level and more powerful swing. It is composed of a batting post with an attached target pad which is attached to a base frame by a pivot rod and a pneumatic retracting mechanism. The frame works to keep balance and control of the moving parts. The batting post operates as you swing and hit the pad connected to it. Once the batting post is hit it will move back and downward between the frames legs where a rubber band strap restrains it from going any further. Then the pneumatic retracting mechanism connecting the frame and the batting post returns the batting post to the starting position where it is ready to be struck again.

7 Claims, 4 Drawing Sheets

BATTING MACHINE

BACKGROUND OF THE INVENTION

The philosophy behind the Batting Machine is similar to that of a boxer's training regimen. A boxer uses a speed bag to develop his speed, reflexes, and eye-hand coordination. He then uses a full size punching bag to develop his point of contact with speed, power, and strength in his punch. A baseball player will use the pitching machine to develop his speed, reflexes, and eye-hand coordination. Then he will use Batting Machine to improve his point of contact with speed, power, and strength to slam the balls out of the park.

BRIEF SUMMARY OF THE INVENTION

The Batting Machine consists of a batting pad which is connected to an adjustable post which, in turn, is connected to a base frame by a retracting mechanism. The unit is portable and can be easily collapsed for storage.

The design can be modified so that people of all ages can use it. Many young baseball players have difficulties swinging the bat properly; they chop at the ball at a 45 degree angle from right to left. Therefore, their balls are either hit into the ground or not at all. When a player uses the Batting Machine, each swing is directed at a solid object, which is the batting pad. The player stands in a batter's position, he then swings the bat with a level swing to strike the pad which is about one and a half to three feet off the ground. As the pad is struck it moves out of the way and allows the batter to complete his swing. The resistance of the impact strengthens the batter's swing. The pad then retracts back into place, ready for the batter to strike it again. There are three levels on the pad to strike. The higher that the pad is hit the easier the pad moves back. The lower the swing the more difficult it is to move the pad on impact. The retracting mechanism can be adjusted so that the batter would have to use more force on impact to move the batting pad.

DESCRIPTION OF DRAWING VIEWS

Figure 4:
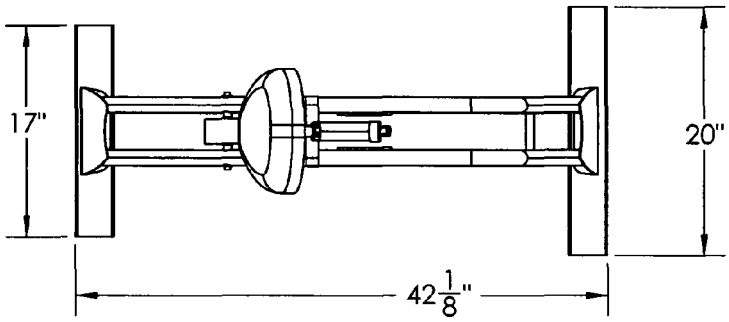
Figure 5:
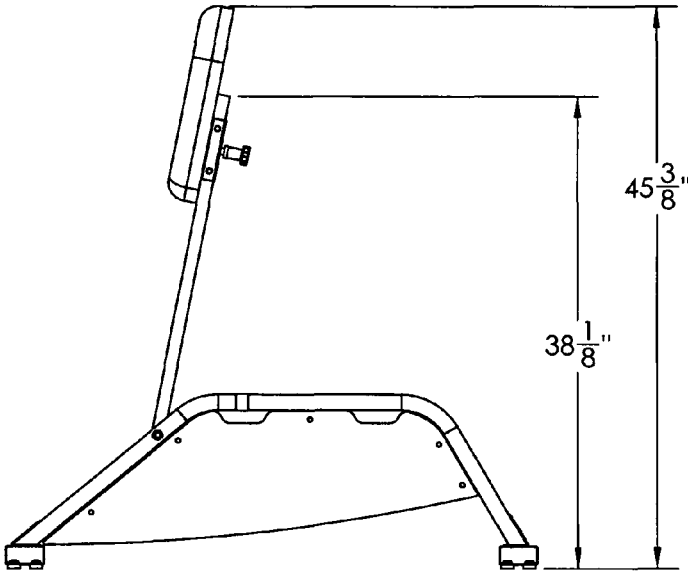
Figure 6:
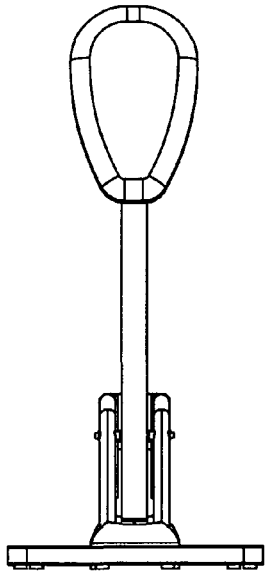
Figure 7:
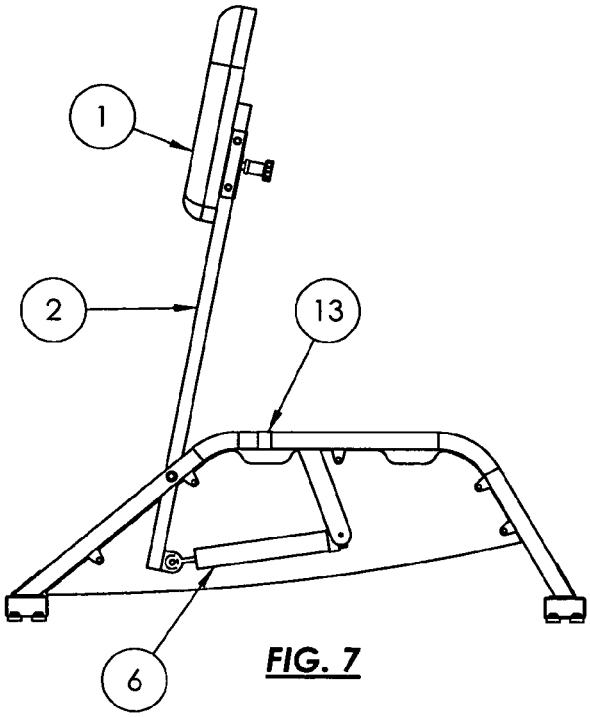

[1] Batting Pad
[2] Batting Post
[3] Pad Bracket
[4] Pad Adjustment Knob
[5] Base Frame
[6] Retracting Mechanism
[7] Pivot Rod
[8] Bushing
[9] Front Base Tube
[10] Rear Base Tube
[11] Rubber Foot
[12] Side Panel
[13] Reflex Band FIG. 4 Top view of the Batting Machine FIG. 5 Right side view of the Batting Machine FIG. 6 Front view of the Batting Machine FIG. 7 Side view of the Batting Machine with one side panel (12) removed to show the inner components.

Figure 8:
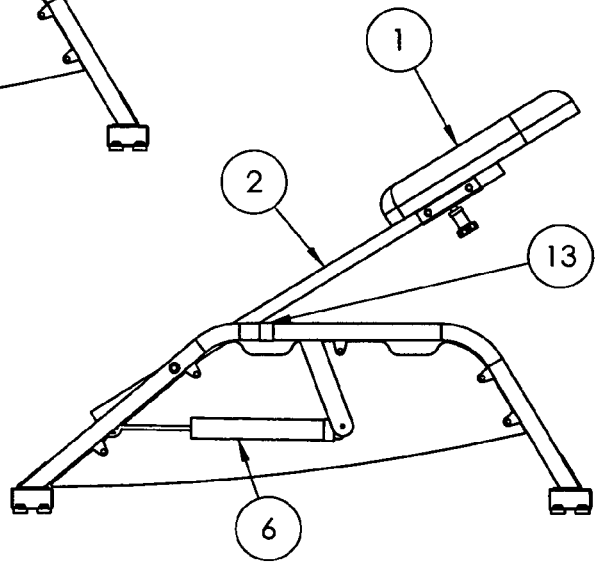

FIG. 8 Side view of the Batting Machine with one side panel (12) removed to show the inner components. This view shows the batting post (2) engaging the reflex band (13) after the batting pad (1) has been struck with a bat.

Figure 9:
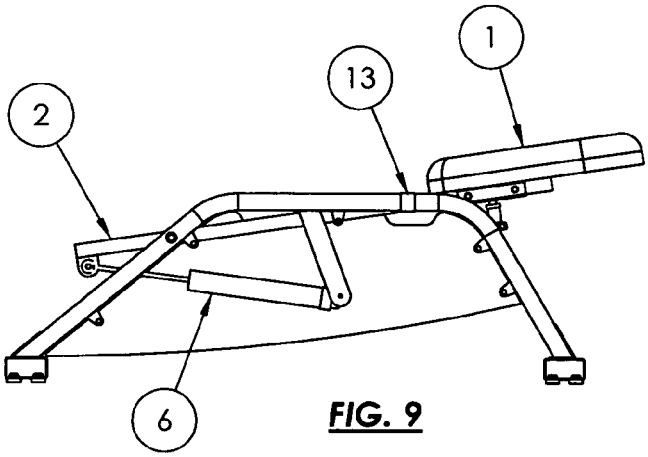

FIG. 9 Side view of the Batting Machine with one side panel (12) removed to show the inner components. This view shows the Batting Machine in its storage/transport position with the batting post (2) being retained by the reflex band (13) to make the unit compact.

DETAILED DESCRIPTION OF THE INVENTION

Figure 1:
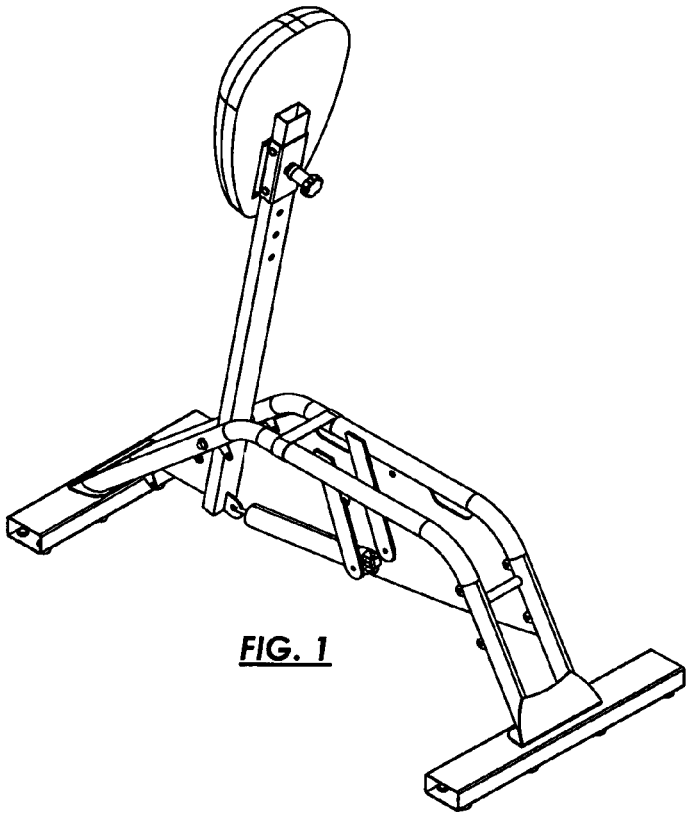
FIG. 1 Shows a back, right view of the assembled Batting Machine with one side panel removed to show the interior details.
Figure 2:
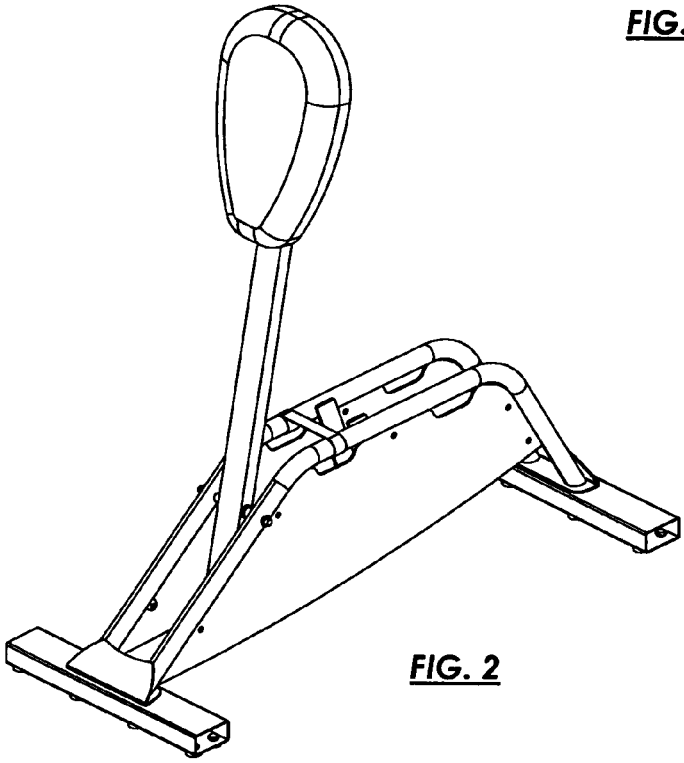
FIG. 2 Shows the front, right view of the assembled Batting Machine with both side panels installed.
Figure 3:
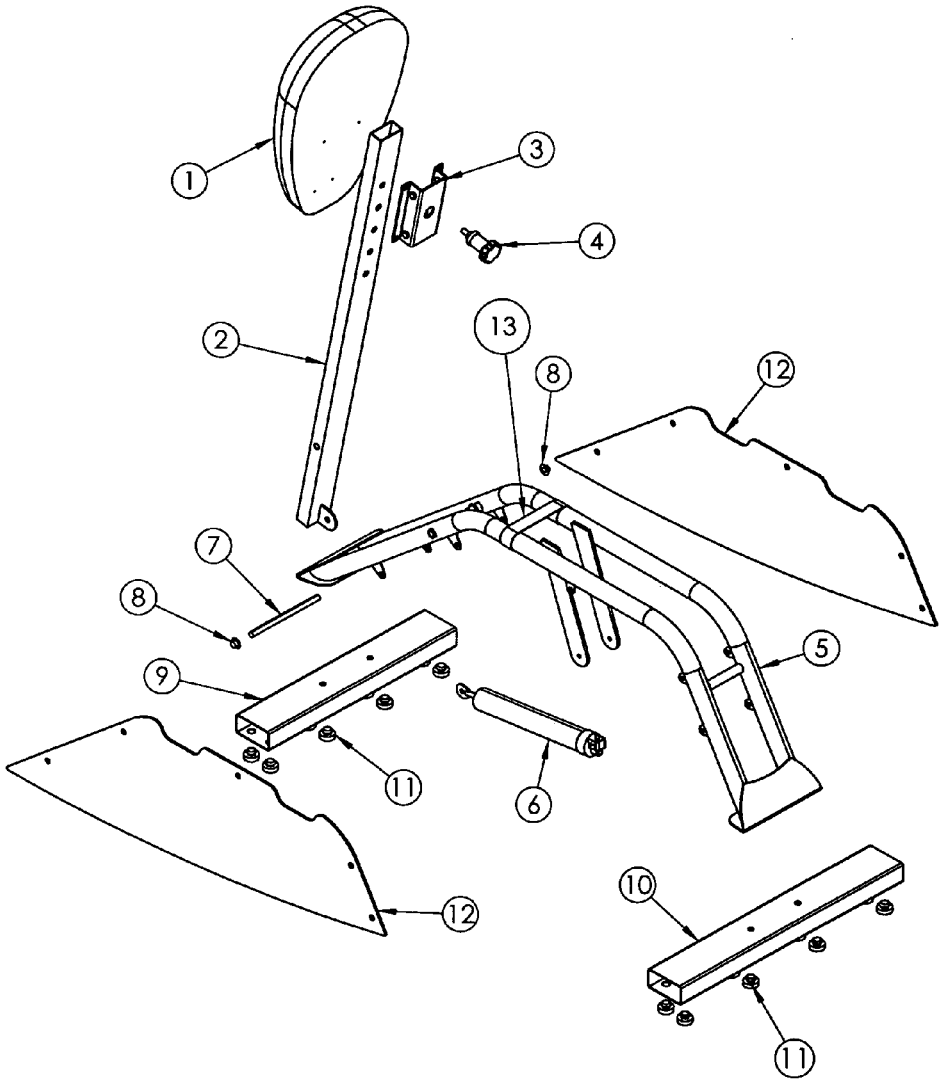
FIG. 3 Is an exploded view of the Batting Machine showing all of its major components which are.

The Batting Machine is composed of thirteen main functional components that work together as a strength training device for baseball batters. Each of these components are clearly seen in FIG. 3. The batting pad (1) is the contact point for the bat and is best constructed of a foam rubber material on a rigid backing such as plywood or sheet metal, and then wrapped in a durable material such as vinyl or leather. The batting pad (1) is attached to the steel batting post (2) via the steel pad bracket (3) and adjustment knob. This allows the height of the batting pad to be adjusted for different batters.

The batting post assembly (1,2,3,4) is connected to the welded steel base frame (5) by a pivot rod (7), retainers (8), and the retracting mechanism (6). The retracting mechanism (6) is a pneumatic cylinder, similar to a screen door closer, and is also connected to the frame with a pivot connection. The combination of the pivot connections and pneumatic action provides three main functions:

1] Provides adjustable resistance to the swing of the batter.

2] Allows the batting post assembly to move out of the way of the swing when struck with the bat.

3] Retracts the batting post assembly to its upright, ready position in a controlled and timely manner.

The Batting Machine's frame is composed of the base frame (5), the front base tube (9), and the rear base tube (10). These are separate components to allow for more economical shipping and storage. The front and rear base tubes have push-in rubber bumpers (11) which keep the frame from sliding on smooth surfaces, as well as act as grippers on turf surfaces.

The Batting Machine includes two graphic side panels (12) which attach to the frame at the small metal tabs. The side panels (12) provide a large area for product identification and marketing, hide the internal components, and protect the user from the moving parts.

When the batting pad (1) is struck with a bat, it pivots down toward the frame where it hits the reflex band (13) as in FIG. 8. The reflex band (13) is a rubber strap that is attached to the base frame (5) with velcro. The batting post (2) then springs upward off the reflex band (13) at which point the retracting mechanism (6) returns the batting post (2) to the ready position. The reflex band (13) also serves another purpose. As shown in FIG. 9, the reflex band (13) can be repositioned to the back of the base frame's (5) top tube where it acts as a retainer to hold the batting post (2) in place for storage or transport.

What is claimed is:

1. An apparatus useful in practicing swinging a baseball bat by a baseball practitioner comprising:

a bent double tubed base frame; said base frame having a primary member and two secondary members; said base frame having two mounting brackets attached to the center of said frame; said mounting brackets having single holes; said base frame having mounting plates on both ends; said mounting plates having two holes; said holes receiving fastening means to fasten either secondary members to either end of said base frame; said secondary members being made of a rectangular tubing; said rectangular tubing secondary members having two holes; vertical primary member pivotally attached by pivot means to said base frame; said vertical primary member is rectangular tubing; said primary member has a hole through the rectangular tube at the bottom end; said primary member having a pneumatic retracting mechanism attached to a bottom hole with a pivot rod and bushing; said pneumatic retracting mechanism being attached to the two mounting brackets on said bent tube base frame; said bent tube base frame having a reflex band attached on opposite side of primary member on base frame; said primary vertical member having an adjustable striking pad bracket that is controlled by a knob; a striking target pad attached to said striking pad bracket with mounting screws.

2. An apparatus useful in practicing swinging a baseball bat as described in claim 1 wherein said primary vertical member will pivot when struck by a baseball bat.

3. An apparatus useful in practicing swinging a baseball bat as described in claim 1 wherein said target is somewhat rectangular in shape with oval ends.

4. An apparatus useful in practicing swinging a baseball bat as described in claim 1 wherein said primary vertical member has vertical adjusting means to accommodate users of a taller or smaller statue.

5. An apparatus useful in practicing swinging a baseball bat as described in claim 1 wherein said pneumatic retracting mechanism has adjusting means for adjusting the rate of travel of the target when a blow to said target actuates said pneumatic retracting mechanism.

6. An apparatus useful in practicing swinging a baseball bat as described in claim 1 wherein said practitioner having struck the batting pad with a baseball bat will cause the vertical tube with the attached batting pad to move in a circular arc.

7. An batting apparatus in combination with a ball bat comprising:

a bent double tubed base frame; said base frame having a primary member and two secondary members; said base frame having mounting plates on both ends; said mounting plates having two holes; said secondary members being made of a tubing; a vertical primary member pivotally attached by pivot means to said base frame and being made of a tubing material; said primary member having a pneumatic mechanism attached to the vertical primary member for returning said primary member to a starting position; said pneumatic retracting mechanism being attached to the two mounting brackets on said bent tube base frame; said tube base frame also having a reflex band attached on opposite side of the primary member on said base frame; said primary member having an adjustable striking pad.

* * * * *